US010864764B1

(12) United States Patent
Paton

(10) Patent No.: US 10,864,764 B1
(45) Date of Patent: Dec. 15, 2020

(54) NOTEBOOK BINDING SYSTEM

(71) Applicant: John Paton, Dublin, OH (US)

(72) Inventor: John Paton, Dublin, OH (US)

( * ) Notice: Subject to any disclaimer, the term of this patent is extended or adjusted under 35 U.S.C. 154(b) by 0 days.

(21) Appl. No.: 16/841,202

(22) Filed: Apr. 6, 2020

(51) Int. Cl.
*B42F 13/16* (2006.01)
*B42F 3/00* (2006.01)
*B42F 3/04* (2006.01)

(52) U.S. Cl.
CPC ..... *B42F 13/16* (2013.01); *B42F 3/003* (2013.01); *B42F 3/006* (2013.01); *B42F 3/04* (2013.01)

(58) Field of Classification Search
CPC ..... B42F 3/003; B42F 3/006; B42F 3/04
USPC ..... 402/501
See application file for complete search history.

(56) References Cited

U.S. PATENT DOCUMENTS 2,368,162 A * 1/1945 Scholfield ..... B42F 17/28 402/501
5,015,114 A * 5/1991 Miller ..... B42F 3/04 402/501
5,553,959 A 9/1996 Feldman et al.
5,749,667 A * 5/1998 Feldman ..... B42F 3/003 402/79
5,888,011 A * 3/1999 Reinbold, Jr. ..... B42F 3/003 402/73

FOREIGN PATENT DOCUMENTS

EP 1072439 A2 * 1/2001 ..... B42F 3/003
GB 191100636 A * 5/1911 ..... B42F 3/003

* cited by examiner

*Primary Examiner* — Kyle R Grabowski
(74) *Attorney, Agent, or Firm* — Standley Law Group LLP; James L. Kwak; Kenny W. Pung

(57) ABSTRACT

A notebook binding system that includes a plurality of sheets and a plurality of ring fastening members. Each sheet of said plurality of sheets includes an edge and a plurality of first openings spaced apart along the edge. Each first opening of the plurality of first openings includes a cap portion and a stem portion between the cap portion and the edge. The plurality of sheets is arranged in a stack such that each first opening of every plurality of first openings is substantially aligned with another first opening of another plurality of first openings. Each ring fastening member of the plurality of ring fastening member is insertable into the first openings of the plurality of sheets to retain the sheets in the stack.

16 Claims, 16 Drawing Sheets

NOTEBOOK BINDING SYSTEM

FIELD

The application relates to notebook binding systems and, more particularly, to notebook binding systems that make use of a plurality of ring fastening members to fasten a plurality of sheets.

BACKGROUND

Notebooks are made by arranging a plurality of sheets into a stack and employing one or more of a variety of fastening mechanisms to retain those sheets in the stack. Conventional fastening mechanisms have included, for example, staples, adhesives, spiraled wire, and the like. Some of these fastening mechanisms, however, are limited in functionality because they are not easily releasable. For example, as is often the case, an owner of a spiral notebook may wish to rearrange the pages of his or her notebook, but doing so is impractical because it would require removing the spiral wire, rearranging the pages, and then reinserting the spiral wire. It is generally contemplated that this process is arduous enough to deter many owners of spiral notebooks from rearranging the pages of their notebooks. As such, a notebook binding system that releasably retains pages is desired.

For example, ring binders are a common type of releasable notebook binding system that makes use of a spine (upon which the rings are mounted) that is fixedly connected to a cover. The rings of the ring binder may then be mechanically opened by hand-pulling the rings or by pressing a button or lever. While ring binders are capable of binding (and then releasing) sheets of loose-leaf paper, it is also generally contemplated that the spine and the cover adds undesired bulk to the design.

Another type of releasable notebook binding system may include, for example, discbound notebook systems. Discbound notebook systems make use of one or more discs and a corresponding number of specialized openings in a sheet (or sheets) to bind those sheets(s) together. The discs are removably insertable into the specialized openings and are configured to retain the sheet(s) relative to one another. However, the centers of the discs often inhibit the free movement of the sheet(s) (e.g., page turning) and preclude the common practice of inserting a writing utensil into the binding mechanism for storage.

Accordingly, those skilled in the art continue with research and development efforts in the field of notebook binding systems.

SUMMARY

Disclosed are notebook binding systems that include a plurality of sheets and a plurality of ring fastening members.

In one example, the disclosed notebook binding system includes a plurality of sheets and a plurality of ring fastening members. Each sheet of the plurality of sheets includes an edge and a plurality of first openings spaced apart along the edge of the sheet. Each first opening of the plurality of first openings includes a cap portion and a stem portion between the cap portion and the edge. The cap portion defines a cap width and the stem portion defines a stem width that is less than the cap width. The plurality of sheets is arranged in a stack such that each first opening of every plurality of first openings is substantially aligned with another first opening of another plurality of first openings. Each ring fastening member of the plurality of ring fastening members is insertable into the first openings of the plurality of sheets to retain the sheets in the stack.

In another example, the notebook binding system includes a plurality of sheets arranged in a stack, a cover proximate the stack, and a plurality of ring fastening members. Each sheet of the plurality of sheets includes an edge and a plurality of first openings spaced apart along the edge of the sheet. The plurality of sheets is arranged such that each first opening of every plurality of first openings is substantially aligned with another first opening of another plurality of first openings. The cover includes an edge and a plurality of second openings spaced apart along the edge of the cover such that each second opening of the plurality of second openings is substantially aligned with a first opening of a plurality of first openings. Each second opening of the plurality of second openings includes a cap portion and a stem portion between the cap portion and the edge, the cap portion defining a cap width and the stem portion defines a stem width that is less than the cap width. The cap portion defines a first arcuate surface, a substantially flat first bearing surface and a substantially flat second bearing surface in the cover. Each ring fastening member of the plurality of ring fastening member is insertable into respective first openings of the plurality of first openings to retain the sheets in the stack. Each ring fastening member of the plurality of ring fastening members is further insertable into a respective second opening of the plurality of second openings to retain the cover proximate the stack.

In yet another example, the notebook binding system includes a plurality of sheets arranged in a stack, a cover proximate the stack, and a plurality of ring fastening members. Each sheet of the plurality of sheets includes an edge and a plurality of first openings spaced apart along the edge of the sheet. Each first opening of the plurality of first openings includes a cap portion and a stem portion between the cap portion and the edge. The cap portion defines a first arcuate surface, a substantially flat first bearing surface and a substantially flat second bearing surface in the sheet. The cap portion further includes a first end portion and a second end portion, wherein the first end portion and the second end portion each comprises a second arcuate surface. The plurality of sheets is arranged such that each first opening of every plurality of first openings is substantially aligned with another first opening of another plurality of first openings. The cover includes an edge and a plurality of second openings spaced apart along the edge of the cover. Each second opening of the plurality of second openings is substantially identical in shape to the plurality of first openings. Further, at least one ring fastening member of the plurality of ring fastening members includes a convex outer surface and a substantially flat inwardly-facing bearing surface configured to bear upon the substantially flat first bearing surface and the substantially flat second bearing surface of the plurality of first openings. At least one ring fastening member of the plurality of ring fastening members is also insertable into respective first openings of the plurality of first openings to retain the sheets in the stack, and is further insertable into a respective second opening of the plurality of second openings to retain the cover proximate the stack.

Other examples of the disclosed notebook binding system will become apparent from the following detailed description, the accompanying drawings and the appended claims.

DETAILED DESCRIPTION

Figure 1:
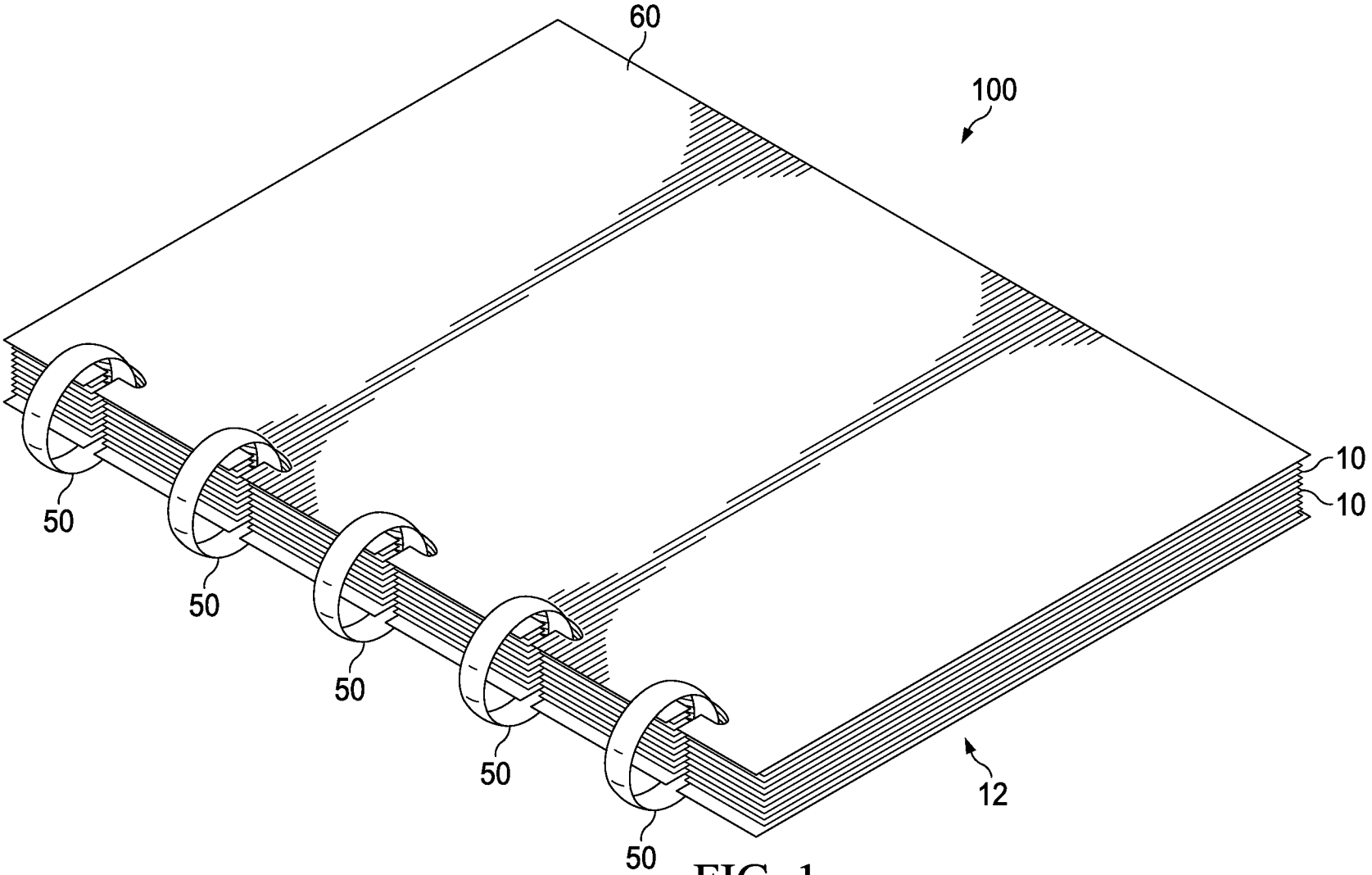
FIG. 1 is a perspective view an example of the disclosed notebook binding system.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

Referring to FIG. 1, the present disclosure provides examples of a notebook binding system 100 that includes a plurality of sheets 10 arranged in a stack 12 and a plurality of ring fastening members 50 configured to retain the sheets 10 in the stack 12. Various examples of the disclosed notebook binding system 100 may differ in terms of the number of sheets 10 and ring fastening members 50 employed, also in terms of the relative physical dimensions of the various components of the notebook binding system 100, as well as their material compositions without departing from the scope of the present disclosure.

In one example, the notebook binding system 100 may include a plurality of sheets 10 that comprises one or more standard A4 sized sheets formed from commercially available paper stock. In another example, the plurality of sheets 10 may include A5 sized sheets formed from a polymeric material. These sheets may be transparent, and may be utilized to overlay images over other sheets 10 in the stack 12. In yet another example, the plurality of sheets 10 may include both aforementioned A4 and A5 size sheets.

Figure 5:
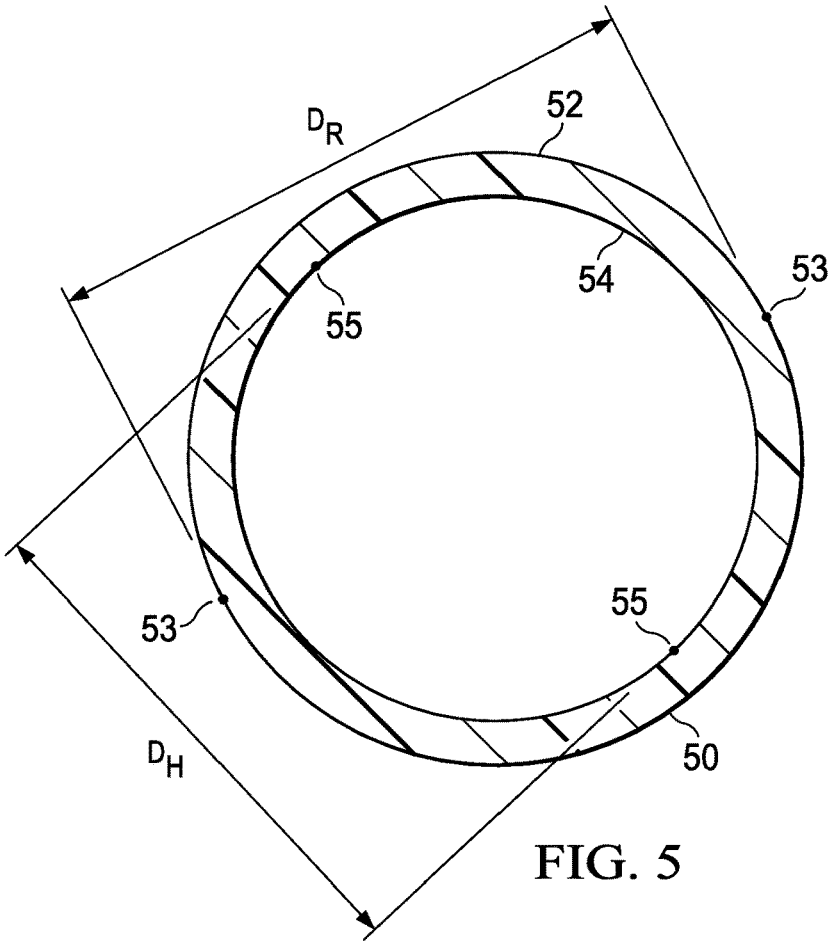
FIG. 5 is a side elevational view of the ring fastening member of FIG. 4.

Further, in one example, the notebook binding system 100 may include a plurality of ring fastening members 50 that comprises one or more ring fastening members 50 having a ring diameter ranging from approximately 0.5 inches to approximately 1.5 inches (FIG. 5). These ring fastening members 50 may be fabricated from, among other things, wooden material, metallic material, polymeric material, and any combinations thereof.

Those skilled in the art will appreciate that incorporating sheets 10 and ring fastening members 50 of differing sizes, shapes (including non-polygonal and non-circular shapes) and material compositions in various embodiments of the notebook binding system 100 will not result in a departure from the present disclosure.

Figure 2:
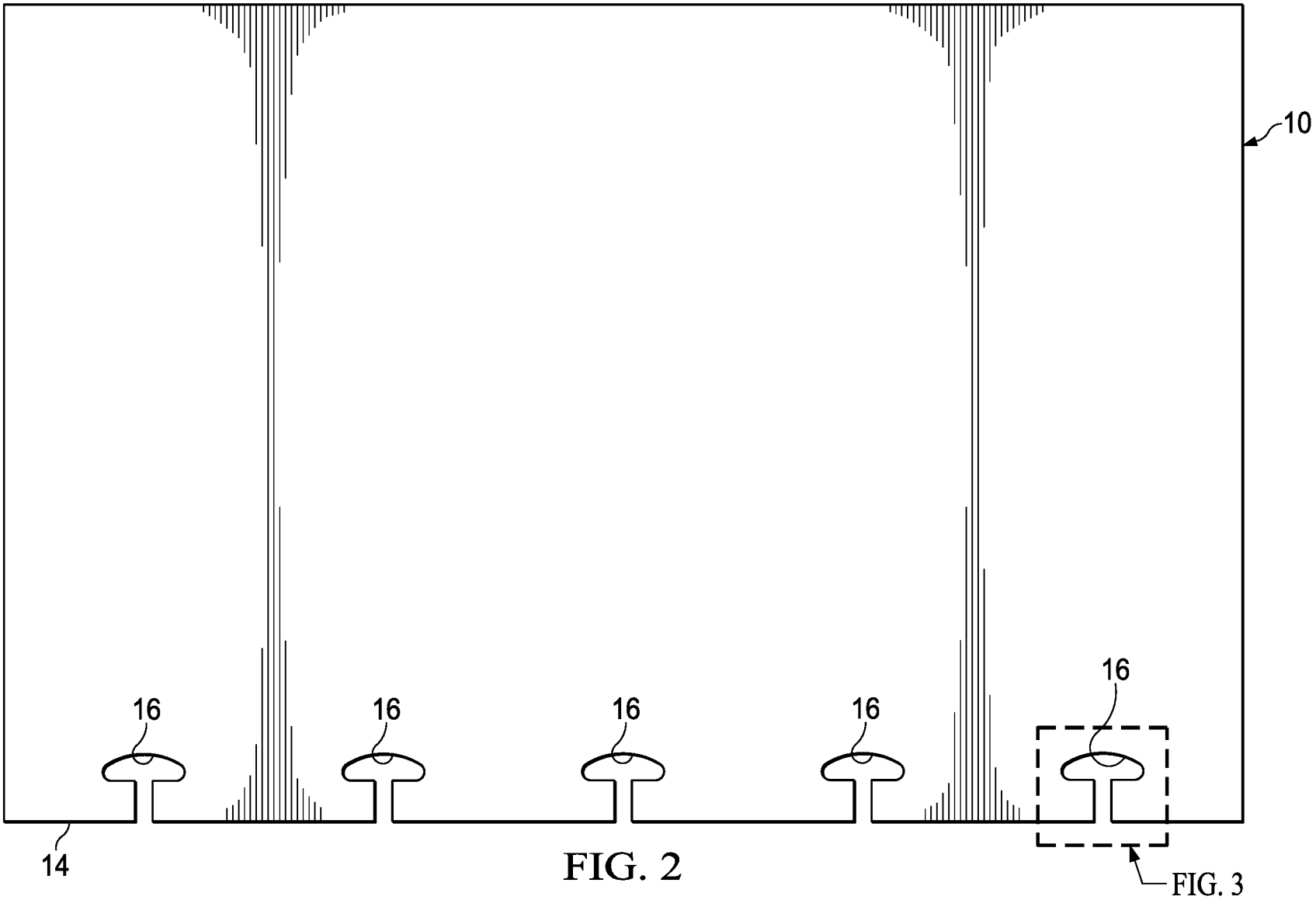
FIG. 2 is a top plan view of a sheet of the plurality of sheets of the notebook binding system of FIG. 1.

Referring to FIG. 2, in one example, each sheet 10 of the plurality of sheets 10 includes an edge 14 and a plurality of first openings 16 spaced apart along the edge 14. As shown, each first opening 16 of the plurality of first openings 16 may be spaced approximately equidistant relative to one another along the linear edge 14. This configuration may enable the smooth movement of the sheets 10 relative to one another once the sheets 10 are fastened by the plurality of ring fastening members 50 (e.g., page turning). However, the relatively uniform spacing of this configuration is not necessary. It is generally contemplated that the notebook binding system 100 will likely still be operable with other spacing configurations (for example, two first openings 16 biased towards the top and two biased towards the bottom).

Once two or more sheets 10 are arranged such that their respective pluralities of first openings 16 are aligned, a stack 12 is formed. The respective alignment of the pluralities of first openings 16 enables a single ring fastening member 50 to fasten multiple sheets 10 of the stack 12. Additional ring fastening members 50 may also be included to further retain the sheets 10 in the stack 12.

Figure 3:
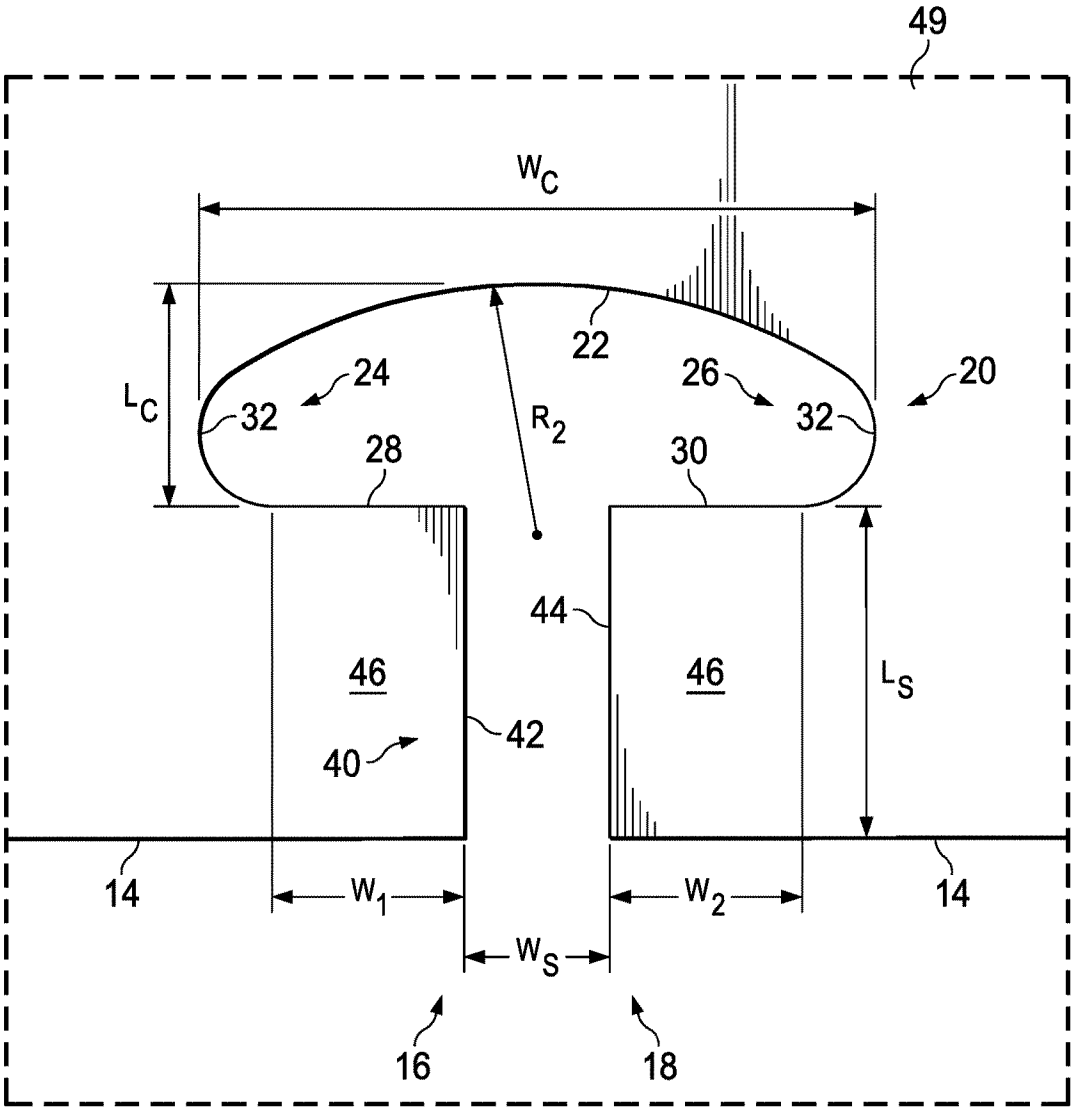
FIG. 3 is a top plan view of a first opening of the plurality of first openings of the sheet of FIG. 2.

Referring to FIG. 3, an example of a suitable first opening 16 (which may be representative of other first openings) is shown. This first opening 16, however, includes a generally mushroom-shaped configuration 18 comprising a cap portion 20 and a stem portion 40 between the cap portion 20 and the edge 14 of the sheet 10. The cap portion 20 and the stem portion 40 may each define a length and a width (e.g., a cap length $L_C$, a cap width $W_C$, a stem length $L_S$, and a stem width $W_S$). In operation, a ring fastening member 50 of the plurality of ring fastening members 50 may be inserted into the first opening 16 by passing through the stem portion 40 and being received in the cap portion 20 (FIGS. 6-12).

The cap portion 20 may be defined by a first arcuate surface 22, a first end portion 24, a second end portion 26, a substantially flat first bearing surface 28, and a substantially flat second bearing surface 30. The first arcuate surface 22 may curve along the width We of the cap portion 20 into the first and second end portions 24, 26 of the cap portion 20. The first and second end portions 24, 26 may each include, for example, second arcuate surfaces 32 that connect the first arcuate surface 22 to the substantially flat first bearing surface 28 and the substantially flat second bearing surface 30. Further, the substantially flat first and second bearing surfaces 28, 30 may each have a width (e.g., $W_1$ and $W_2$) and, as configured, the width $W_1$ of the substantially flat first bearing surface 28 may be substantially equal to the width $W_2$ of the substantially flat second bearing surface 30 (but in other examples, need not be).

The stem portion 40 may be defined by a first opposing surface 42 and a second opposing surface 44, wherein the first opposing surface 42 is opposed from the second opposing surface 44. The width of the stem portion $W_S$ may be measured between these two opposing surfaces 42, 44. As shown, the first and second opposing surfaces 42, 44 may each be relatively linear and may extend into the sheet 10 generally perpendicular from the edge 14. Accordingly, the stem portion 40 of the first opening 16 may be substantially rectangular in shape. In one or more other examples, however, the opposing surfaces 42, 44 may be non-linear (e.g., angled and/or curved) and may be angled differently (e.g., non-perpendicular), thereby corresponding to stem portions 40 of varying shapes and angular orientations. Further, the first and second opposing surfaces 42, 44 may each be respectively located on opposing portions 46 of the sheet 10 (collectively referred to as a "pair of opposing portions"), wherein each opposing portion 46 of the pair of opposing portions 46 also includes one of the substantially flat first and second bearing surfaces 42, 44, as well as a portion of the edge 14.

Figure 4:
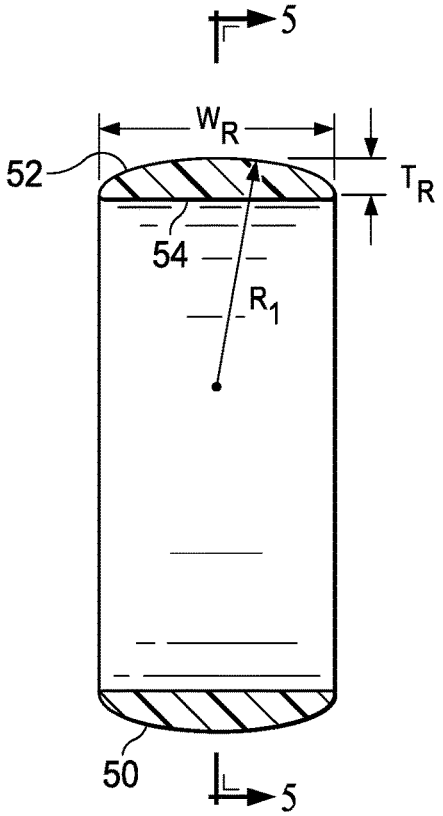
FIG. 4 is a front elevational view of a ring fastening member of the plurality of ring fastening members of the notebook binding system of FIG. 1.

Referring to FIGS. 4 and 5, an example of a suitable ring fastening member 50 (which may be representative of other ring fastening members) is shown. This ring fastening member 50 was formed as a single monolith piece but other ring fastening members 50 of the plurality of ring fastening members 50 need not be. The ring fastening member 50 includes a convex outer surface 52 and a substantially flat inwardly-facing bearing surface 54. The convex outer surface 52 is shaped to correspond with the first arcuate surface 22 of the cap portion 20, and the substantially flat inwardly-facing bearing surface 54 is configured to engage at least one of the substantially flat first bearing surface 28 and the substantially flat second bearing surface 30. Further, the ring fastening member 50 defines a ring diameter $D_R$ measured between two diametrically opposed points 53 on the convex outer surface 52, and a hole diameter $D_H$ measured between two diametrically opposed points 55 on the substantially flat inwardly-facing bearing surface 54. Also defined is a ring thickness $T_R$ and a ring width $W_R$. The exact physical dimensions of any given aspect of the ring fastening member 50 may be varied as needed to accommodate stacks 12 of differing shapes and thicknesses.

In many ways, it is generally useful to describe the physical dimensions of the various features of the notebook binding system 100 in relative terms (e.g., relative to one feature of the notebook binding system or another). For example, the plurality of ring fastening members 50 may include a ring fastening member 50 having a hole diameter $D_H$ that ranges from about 61 percent to about 95 percent of its ring diameter $D_R$. In another example, the stack 12 of sheets 10 may define a stack thickness that is less than 75 percent of the hole diameter $D_H$. In yet another example, the cover may include a cover thickness, the stack of sheets may include a stack thickness, and the combination of the stack thickness and the cover thickness is less than 90 percent of the hold diameter $D_H$. In one further example, the stem widths $W_S$ of the first openings may be less than about 25 percent of the cap widths We of the first openings. By describing these physical dimensions in terms of ratios and/or percentages, it may be possible to retain the same general configuration of the notebook binding system 100 despite scaling up or down in size.

The ring fastening members 50 are particularly well suited to being described in this way, especially in relation to the first openings 16. The relative physical dimensions of these two features is critical to the operability of the overall notebook binding system 100. In one example, the convex outer surface 52 of the ring member 50 may have a first arc radius $R_1$ that defines the curvature of the convex outer surface 52 (FIG. 4). Similarly, the first arcuate surface 22 may have a second arc radius $R_2$ that defines the curvature of the first arcuate surface 22 (FIG. 3). In this example, the first arc radius $R_1$ may be less than the second arc radius $R_2$, corresponding to a ring fastening member 50 that is narrower than the cap portion 20 within which it is received. By virtue of being narrower, the ring fastening member 50 may be provided with a degree of clearance within the cap portion 20 to freely move about it. Further, in another example, the ring width $W_R$ of the ring fastening member 50 may be less than 90 percent, but preferably less than 84 percent of the cap width $W_C$, and the stem width $W_S$ may be at least 15 percent, but preferably at least 26 percent of the ring width $W_R$. This ensures that the ring fastening member 50 is not too wide to fit within the cap portion 20 and the stem portion 40 of the first opening 16. In yet another example, the thickness $T_R$ of the ring fastening member 50 may be less than 55 percent of the cap length $L_C$. This ensures that the ring fastening member 50 will be able to pass through the stem portion 40 and be centered within the cap portion 50 of the first opening 16.

The width $W_R$ of a ring fastening member 50 is larger than the width $W_S$ of a stem portion 40. However, the extent to which it is larger primarily depends on the flexural rigidity of the respective sheet 10. For example, the stem portions 40 on comparatively less rigid sheets 10 (e.g. sheets of standard paper stock) can be relatively narrow (e.g., FIG. 3) because the opposing portions 46 may be able to bend around a ring fastening member 50, thereby widening the stem portion 40 far enough to allow the ring fastening member 50 to pass into the cap portion 20 of the first opening 16. On the other hand, comparatively more rigid sheets 10 (e.g., thicker sheets of plastic) have opposing portions 46 that may not be able to bend as much (if at all). Thus, these stem portions 40 must be comparatively wider (e.g., FIG. 10) to compensate for the lack of bending ability. To account for these differences in stem widths $W_S$, two different methods have been developed for inserting a ring fastening member 50 into a first opening 16 (discussed below). The first method may be suitable for less rigid sheets 10, whereas the second method may be suitable for more rigid sheets 10. These two methods are described below.

Figure 6:
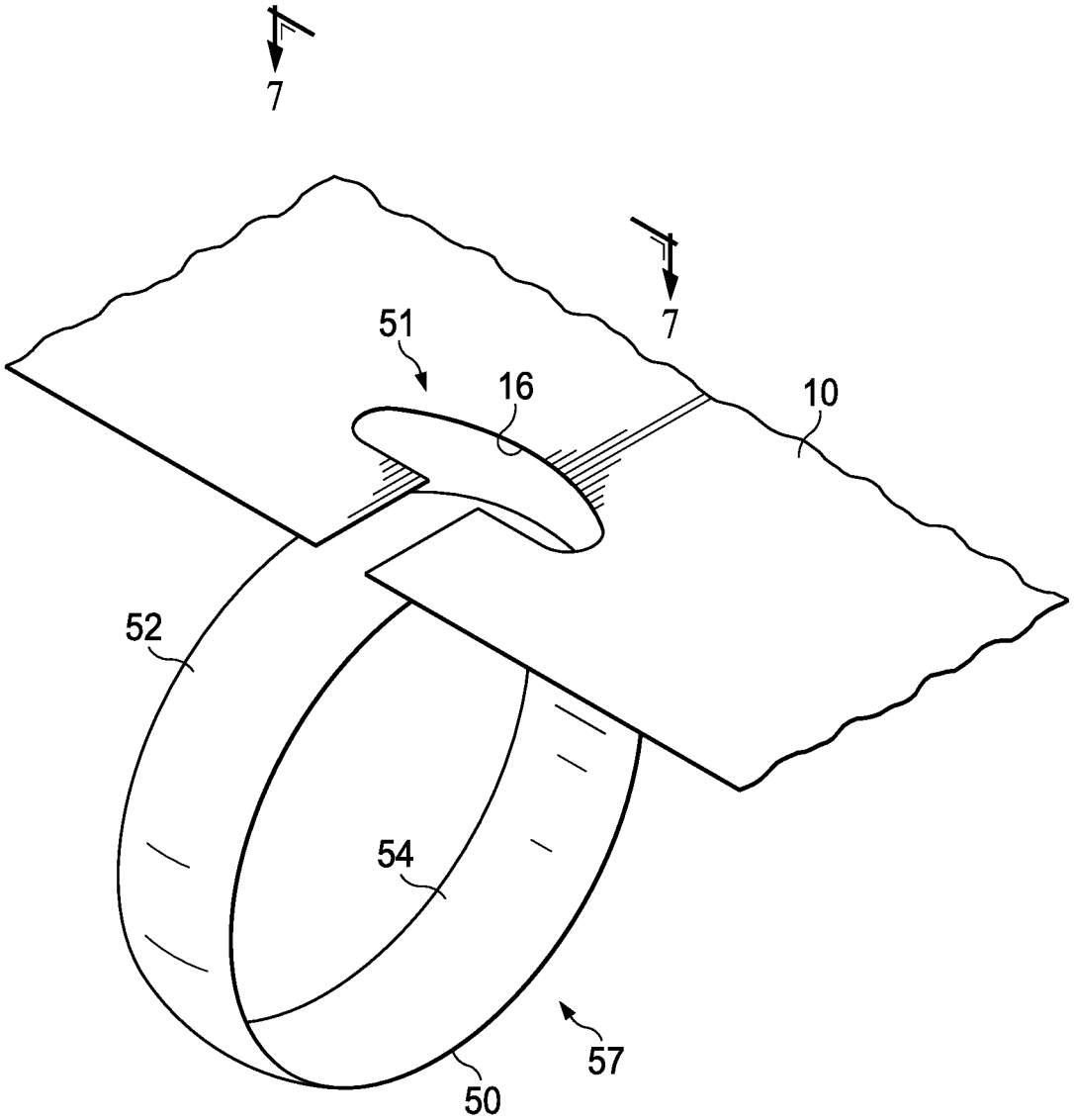
FIG. 6 is a perspective view of a ring fastening member being positioned proximate a first opening.
Figure 7:
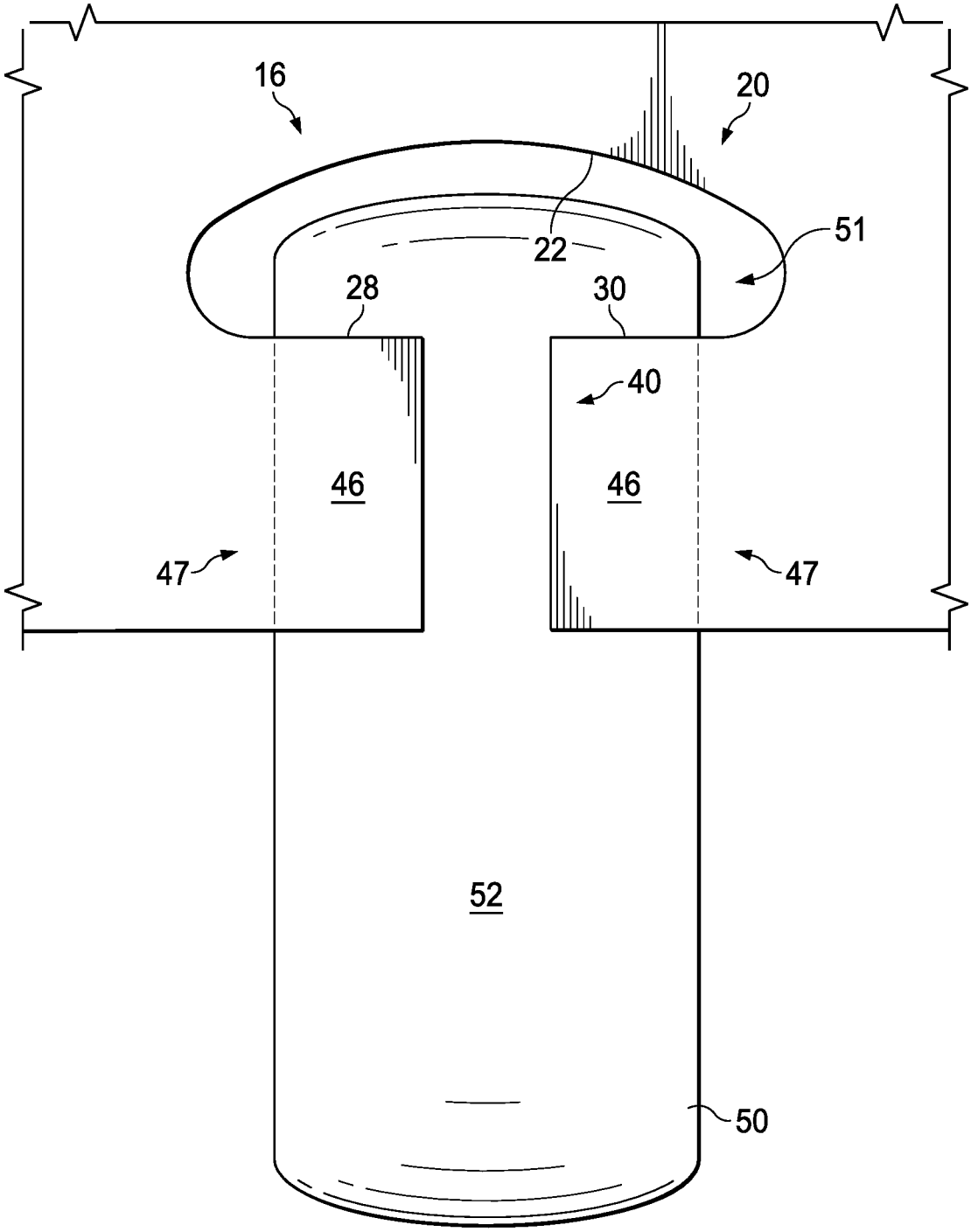
FIG. 7 is a top plan view of the ring fastening member and the first opening of FIG. 6 after the ring fastening member has been positioned proximate the first opening.
Figure 8:
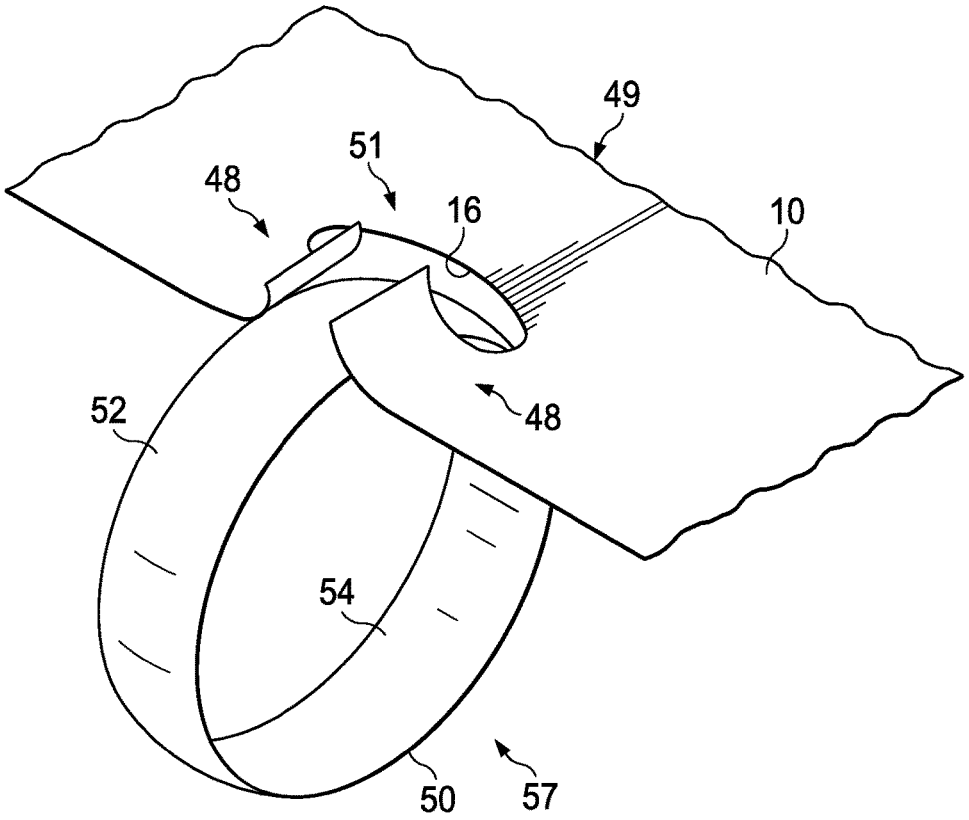
FIG. 8 is a perspective view of the ring fastening member of FIG. 6 being inserted through the first opening of FIG. 6.
Figure 9:
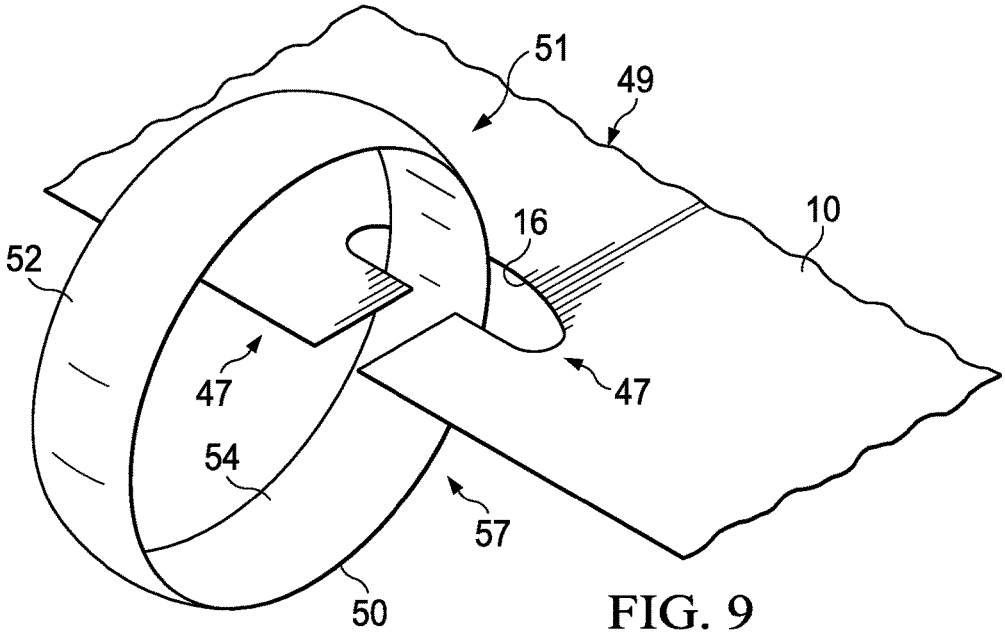
FIG. 9 is a perspective view of the ring fastening member of FIG. 6 being retained within the first opening of FIG. 6.

Referring to FIGS. 6-9, a demonstrative sequence of steps is shown to describe the first method by which a ring fastening member 50 may be inserted into a first opening 16. This method may be suitable for first openings 16 having narrow stem portions 40, such as the first opening shown in FIG. 3. Here, the opposing portions 46 are bendable between at least a planar configuration 47 and a bent configuration 48 (FIGS. 8 and 9). In the planar configuration 47, the opposing portion 48 is coplanar with the remainder of the sheet 49 (herein referred to as a "remainder portion"). In the bent configuration 48, the opposing portion 46 is not coplanar with the remainder portion 49. As configured, a ring fastening member 50 may be permitted to pass through the stem portion 40 when at least one opposing portion 46 of the pair of opposing portions 46 in the bent configuration 48, and may be prevented from passing through when at least one opposing portion 46 of the pair of opposing portions 46 is in the planar configuration 47.

Referring specifically to FIG. 6 (step 1), the first method may begin by positioning a ring fastening member 50 proximate a first opening 16 such that a portion 51 of the ring fastening member 50 is aligned with the cap portion 20 of the first opening 16. The pair of opposing portions 46 are in the planar configuration 47. The alignment may be achieved from either side of the sheet 10. As shown, the ring fastening member 50 may be positioned beneath the sheet 10 (FIG. 7).

Referring specifically to FIG. 8 (step 2), the ring fastening member 50 may then be inserted through the first opening 16 from the side it was positioned in step 1. In doing so, the pair opposing portions 46 contacts the convex outer surface 52 of the ring fastening member 50 and bends around it (e.g., from a planar configuration 47 to a bent configuration 48). Once said portion 51 of the ring fastening member 50 has been received within the cap portion 20 of the first opening 16, and the convex outer surface 52 moves past the pair of opposing portions 46, the ring fastening member 50 has been inserted far enough.

Referring specifically to FIG. 9 (step 3), the opposing portions 46 may then bend back into their planar configurations 48 within the vacant center 57 of the ring fastening member 50. Since the width $W_S$ of the stem portion 40 is less than the width $W_R$ of the ring fastening member 50, the substantially flat first and second bearing surfaces 20, 30 of the cap portion 20 will engage the substantially flat inwardly-facing bearing surface 54 of the ring fastening member 50, thereby retaining the ring fastening member 50 within the cap portion 20 of the first opening 16.

Figure 10:
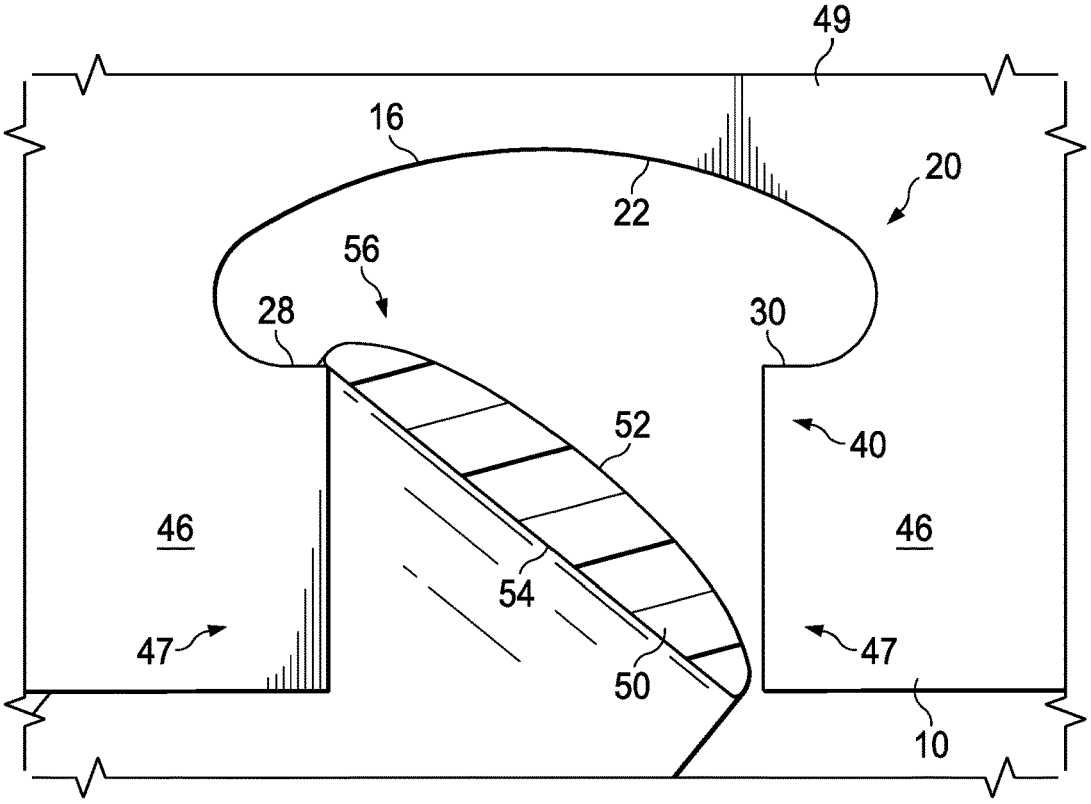
FIG. 10 is a schematic illustration of a ring fastening member being inserted into the stem portion of a first opening.
Figure 11:
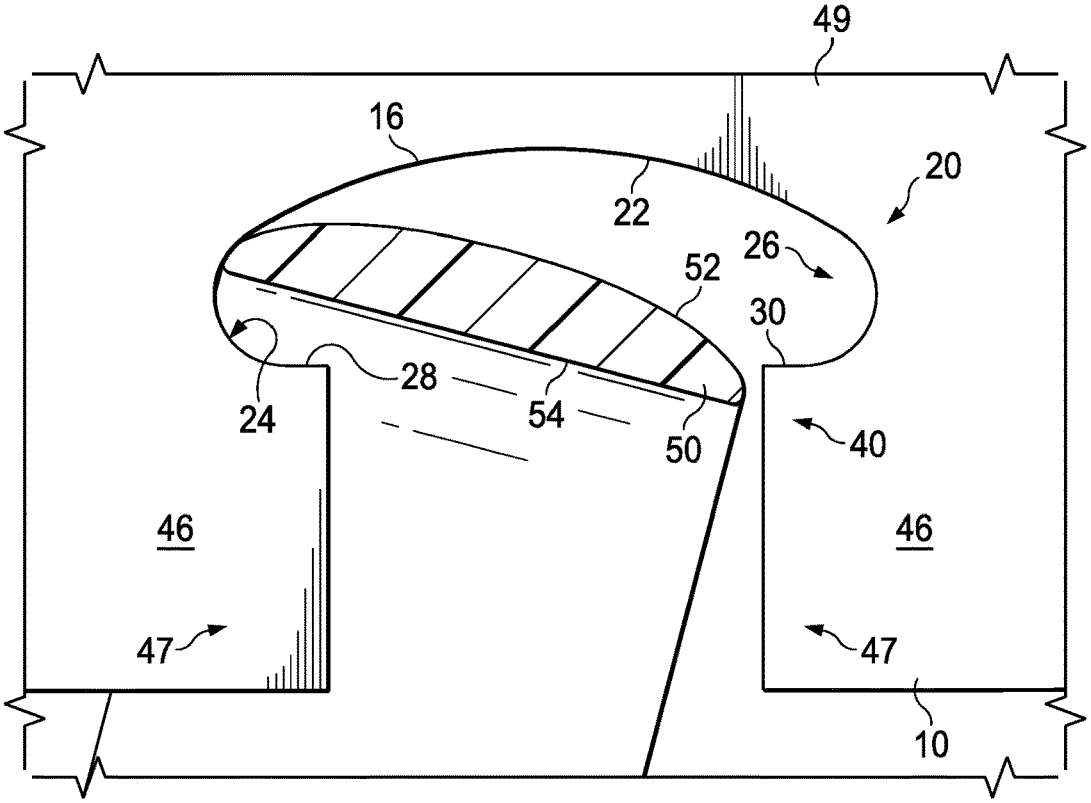
FIG. 11 is a schematic illustration of the ring fastening member of FIG. 10 being urged into the first end portion of the cap portion of the first opening of FIG. 6.
Figure 12:
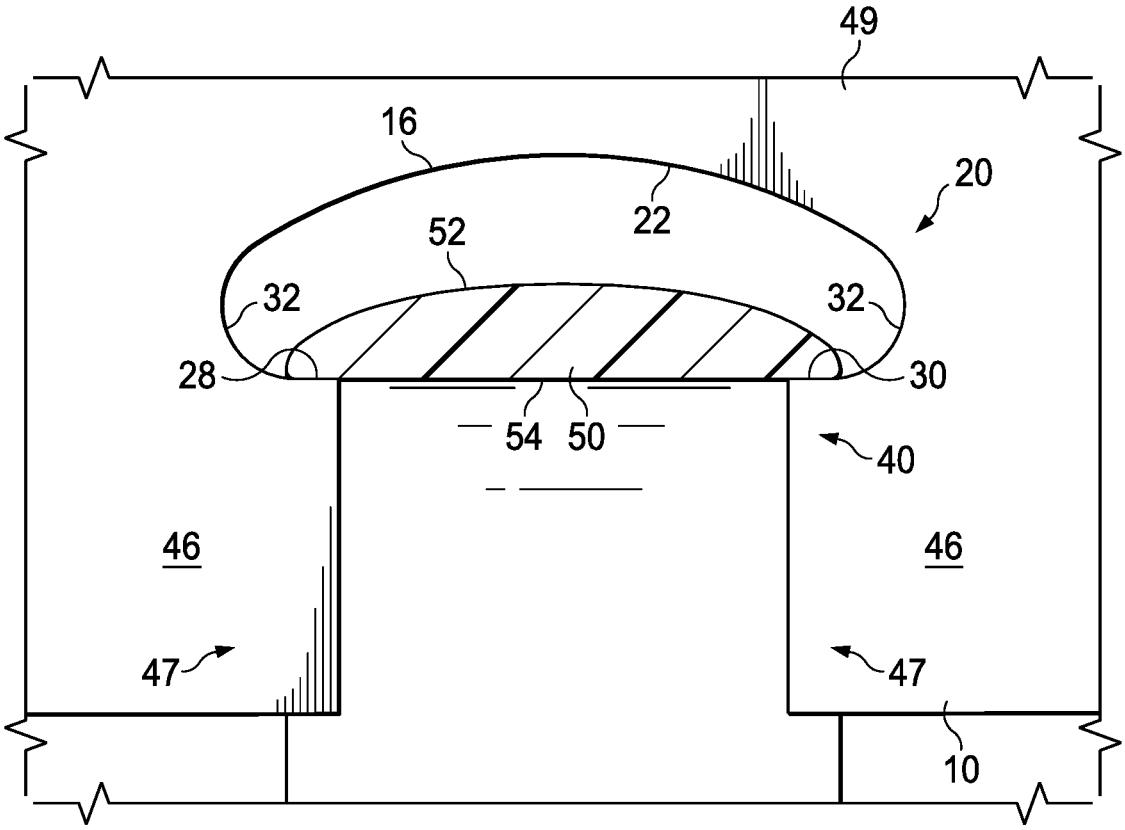
FIG. 12 is a schematic illustration of the ring fastening member of FIG. 10 being centered in the cap portion of the first opening of FIG. 6.

Referring to FIGS. 10-12, a demonstrative sequence of steps is shown to describe the second method by which a ring fastening member 50 may be inserted into a first opening 16. This method may be suitable for first openings 16 having wide stem portions. Here, the opposing portions 46 are unable to bend and thus, are permanently in the planar configuration 47.

Referring specifically to FIG. 10 (step 1), the ring fastening member may be inserted into a stem portion at an angle such that one side 56 of the ring fastening member 50 (e.g., along the interface between the convex outer surface 52 and the substantially flat inwardly-facing bearing surface 54) enters the stem portion 40 first. In the configuration shown, the width $W_R$ of the ring fastening member 50 is greater than the stem width $W_S$. Thus, in angling the ring fastening member 50, the ring fastening member 50 may be inserted into the stem portion 40 without damaging the sheet 10, despite otherwise being too wide.

Referring specifically to FIG. 11 (step 2), once the leading side 56 of the ring fastening member 50 has entered the cap portion 20, that side 56 of the ring fastening member 50 may then be urged into either first end portion 24 or the second end portion 26. Doing so provides the ring fastening member 50 with enough clearance to completely enter the cap portion 20.

Referring specifically to FIG. 12 (step 3), the ring fastening member 50 may then straighten out in the cap portion 20 such that the substantially flat inwardly-facing bearing surface 54 generally aligns (e.g., is parallel) with and/or engages at least one of the substantially flat first bearing surface 28 and the substantially flat second bearing surface 30. The second arcuate surfaces 32 of the first and second end portions 24, 26 of the cap portion 20, by virtue of being curved, may urge the ring fastening member 50 towards a more centered alignment (e.g., self-centering).

Either of the above methods, whichever is appropriate, may be repeated to insert additional ring fastening members 50 into other first openings 16 of the same sheet 10 and/or to fasten additional sheets 10 with the same ring fastening member 50. Conversely, the above methods may also be reversed to remove ring fastening members 50 from a first opening 16 and/or to remove sheets 10 from the stack 12.

Furthermore, those skilled in the art will appreciate that adding more sheets 10 to the stack 12—especially sheets 10 having narrow stem portions 40—may, in effect, "lock" the other sheets 10 into place. For example, groups of sheets 10 having narrow stem portions 40 will have pairs of opposing portions 46 that are substantially aligned with one another. Once fastened, these pairs of opposing portions 46 may collectively impart greater resistance to being bent by a ring fastening member 50 (either intentionally or unintentionally, in the way shown in FIG. 8), thereby preventing the narrow stem portions 40 from widening far enough to permit a ring fastening member 50 to pass though. Further, the substantially flat first and second bearing surfaces 28, 30 of the narrow stem portions 40 are simply too wide to permit a side 56 of a ring fastening member 50 to be angled far enough within a cap portion 20 such that the ring fastening member 50 passes into a stem portion 40 (see FIGS. 10-12 in reverse order), thereby "locking" the ring fastening member 50 within the cap portion 20. For this reason, it is generally contemplated that ring fastening members 50 should be inserted into first openings 16 having wide stem portions 40 (which may be necessary for rigid sheets) before being inserted into narrow stem portions (e.g., because once a ring fastening member 50 has been inserted into a narrow stem portion 40, that ring fastening member 50 will no longer be able to be removed using the second method).

Exemplary examples of a first opening 16 having a narrow stem portion 40, a first opening 16 having a wide stem portion 40, and a ring fastening member 50 capable of being inserted into either first openings 16 will now be described.

Narrow Stem Portion: In this example, the first opening 16 may include a cap portion 20 and a stem portion 40. The cap portion 20 may have a cap length $L_C$ of about 3 millimeters and a cap width $W_C$ of about 9 millimeters. The first arcuate surface 22 may define an arc radius $R_2$ of about 7.65 millimeters, and the first and second end portions 24, 26 may each include second arcuate surface 32 that define arc radii of about 1.0 millimeters. The substantially flat first and second bearing surfaces 28, 30 of the cap portion 20 may each be about 3.5 millimeters wide. Further, the stem portion 40 of this exemplary example may have a stem length $L_S$ of about 4.5 millimeters and a stem width $W_S$ of about 2 millimeters.

Wide Stem Portion: In this example, the first opening 16 may include a cap portion 20 and a stem portion 40. The cap portion 20 may have a cap length $L_C$ of about 3 millimeters and a cap width $W_C$ of about 9 millimeters. The first arcuate surface 22 may define an arc radius $R_2$ of about 7.65 millimeters, and the first and second end portions 24, 26 may each include second arcuate surface 32 that define arc radii of about 1.0 millimeters. The substantially flat first and second bearing surfaces 28, 30 of the cap portion 20 may each be about 0.75 millimeters wide. Further, the stem portion 40 of this exemplary example may have a stem length $L_S$ of about 4.5 millimeters and a stem width $W_S$ of about 5.5 millimeters.

Ring Fastening Member: In this example, the ring fastening member 50 may include, for example, a convex outer surface 52 and a substantially flat inwardly-facing bearing surface 54. As such, the ring fastening member 50 may include a hole diameter $D_H$ of about 17 millimeter and a ring thickness $T_R$ of about 1.47 millimeters, thereby corresponding to an overall ring diameter $D_R$ of about 19.94 millimeters. Further, the ring fastening member 50 may also include a ring width $W_R$ of about 7.51 millimeters, and the convex outer surface may define an arc radius of about 7.6 millimeters. This ring fastening member may be employed to fasten a stack of sheets having a stack thickness ranging from about 0.1 inches to about 0.6 inches.

Figure 13A:
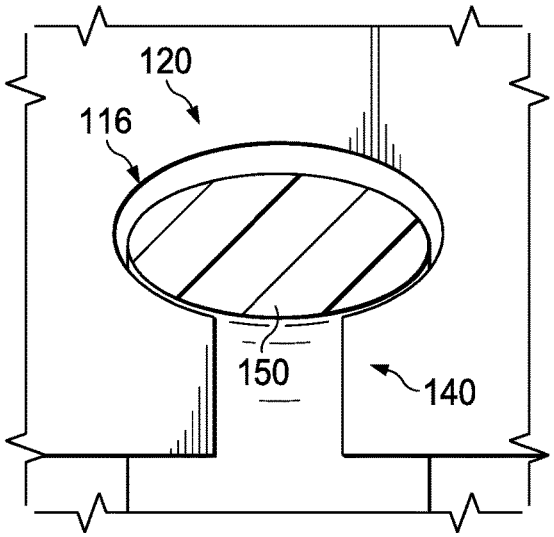
FIGS. 13A-13E are top plan views and cross-sectional views of alternative examples of first openings and ring fastening members, respectively.
Figure 13B:
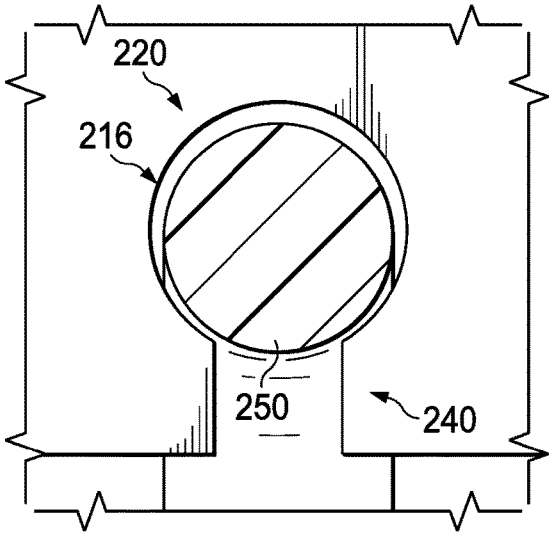
Figure 13C:
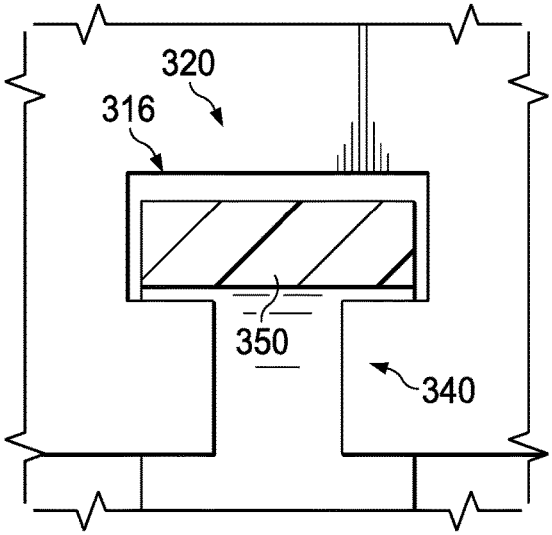
Figure 13D:
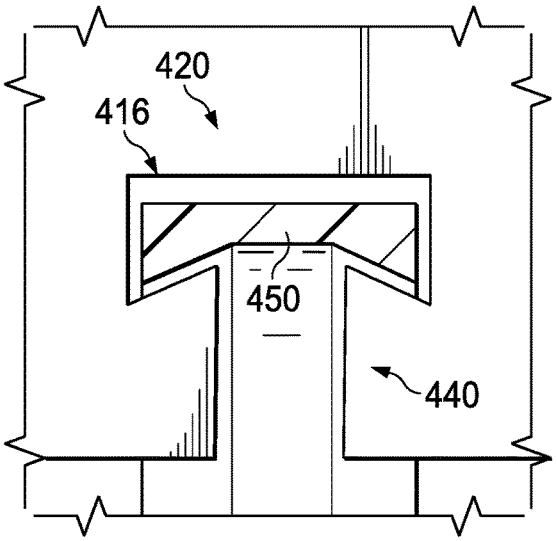
Figure 13E:
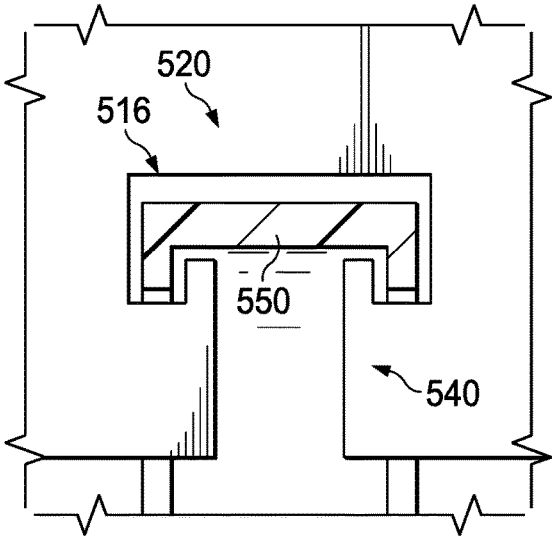

Referring to FIGS. 13A-13E, alternative examples of first openings 116, 216, 316, 416, 516 are shown. These first openings 116, 216, 316, 416, 516 differ from the previously described first openings 16 in that they contain cap portions 120, 220, 320, 420, 520 of different shapes. These shapes are not meant to be limiting, as those skilled in the art will appreciate that other shapes are certainly possible, but they include, for example, an oval (FIG. 13A), a circle (FIG. 13B), a rectangle (FIG. 13C), a concave hexagon (FIG. 13D), and a concave octagon (FIG. 13E). The stem portions 140, 240, 340, 440, 540 of these first openings 116, 216, 316, 416, 516 are varied as necessitated by design. They may be longer or shorter, wider or narrower, all without departing from the scope of the present disclosure. Further, also shown in FIGS. 13A-13E are correspondingly shaped ring fastening members 150, 250, 350, 450, 550. These ring fastening members 150, 250, 350, 450, 550, by and large, have cross-sectional shapes that match (i.e., are substantially similar to) the shapes of the cap portions 120, 220, 320, 420, 520 within which they may be received, albeit relatively smaller. The different shapes notwithstanding, these ring fastening members 150, 250, 350, 450, 550 may be inserted into their corresponding first openings 116, 216, 316, 416, 516 using at least one of the aforementioned methods for inserting (FIGS. 6-12).

In addition to the plurality of sheets 10 and the plurality of ring fastening members 50, the notebook binding system 100 may also include one or more additional features to improve the overall functionality of the notebook binding system 100. These features may include, for example, insertion aids 91, covers 60, dividers 90, identification tabs 96 and rod members 98 (e.g., for hanging). Various embodiments of the notebook binding system 100 that include one or more of these additional features are discussed below.

Figure 14:
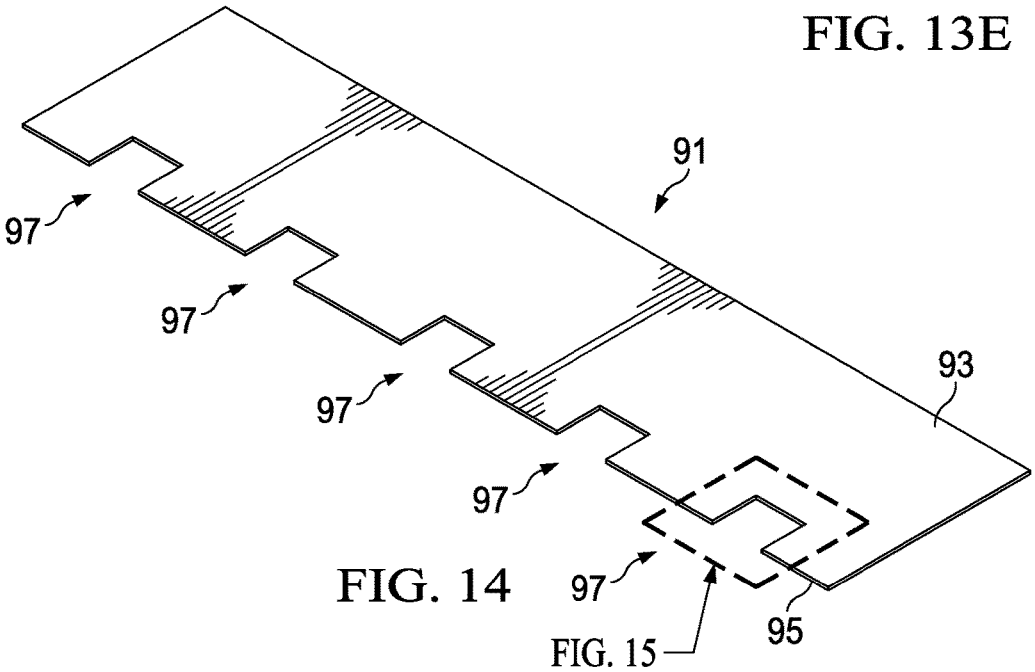
FIG. 14 is a perspective view of an insertion aid.

Referring to FIG. 14, the notebook binding system 100 may be provided with an insertion aid 91 that may be used to facilitate steps 1-3 of the first method. The insertion aid 91 includes a body 93 having at least one side 95, wherein one of those sides includes a plurality of notches 97. Each notch 97 of the plurality of notches 97 defines a length $L_N$ and a width $W_N$. As shown, the body 93 may be relatively thin and generally rectangular in shape, with the plurality of notches 97 being disposed along one of the linear sides 95. Those skilled in the art will appreciate that the size, shape and position of any given notch 97 may vary depending on the size, shape, and position of the plurality of ring fastening members 50. In one example, the length may be, for example, less than 60% of the ring diameters $D_R$ of the ring fastening members 50. In another example, the width $W_R$ of the ring fastening members 50 may be less than 85% of the width $W_N$ of the notch. Whatever the case, ideally, the insertion aid 91 should be configured such that each ring fastening member 50 of the plurality of ring fastening members 50 may be simultaneously received within corresponding a notch 97. In the embodiment shown in FIG. 14, the five notches of the insertion aid therein correspond to the five ring fastening members of the notebook binding system shown in FIG. 1.

Figure 15:
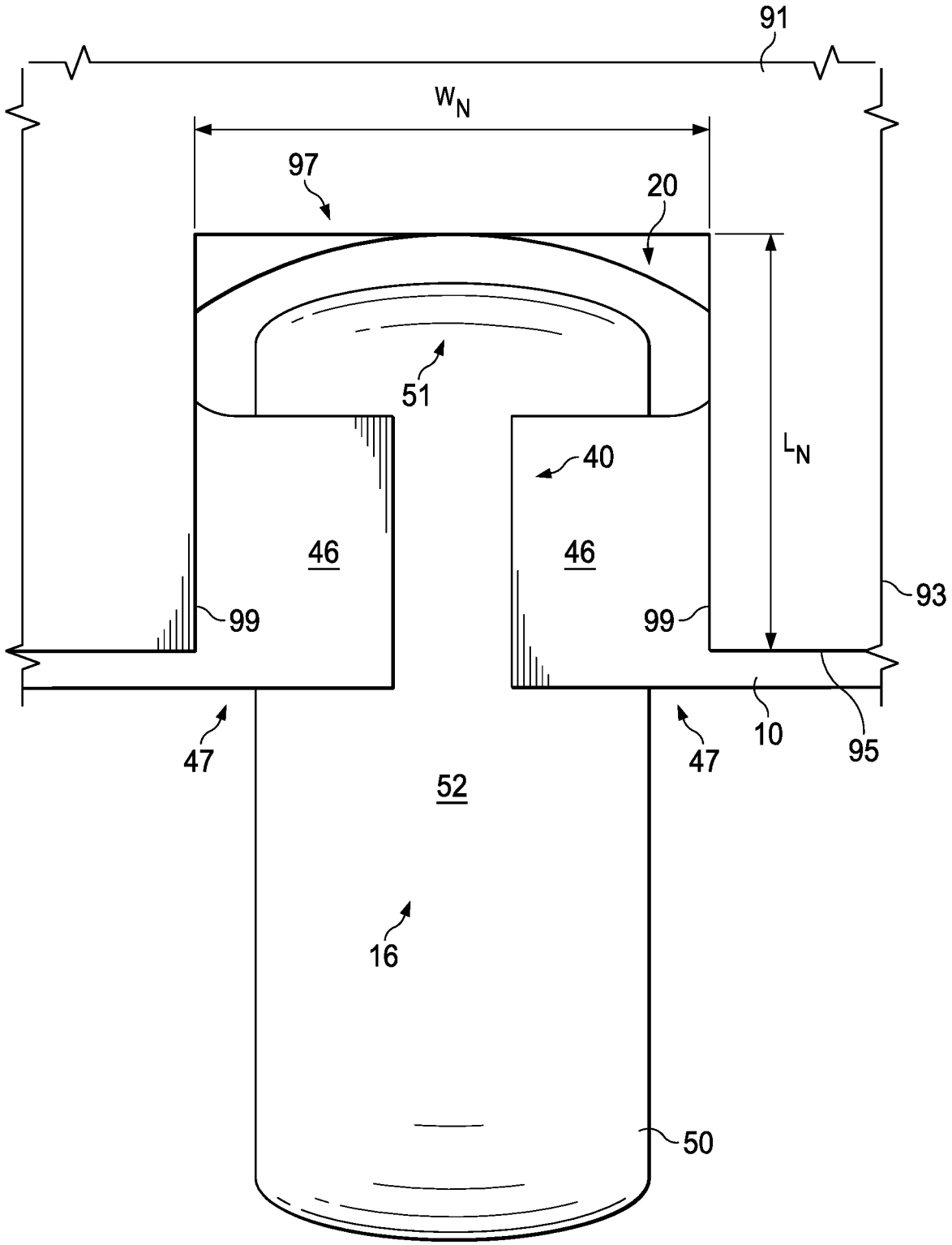
FIG. 15 is a top plan view of a notch of the insertion aid of FIG. 14.

Referring to FIG. 15, a sheet 10 of the plurality of sheets 10 may be positioned between a ring fastening member 50 and the insertion aid 91 such that a portion 51 of the ring fastening member 50 aligns with both a first opening 16 of the sheet 10 and a notch 97 of the insertion aid 91. By using the insertion aid 91 to urge the sheet 10 towards the ring fastening member 50 (step 1), the pair of opposing portions 46 of the first opening 16 may bend around the convex outer surface 52 of the ring fastening member 50 (step 2) while the length-wise sides 99 of the notch urges the opposing portions 46 back towards their planar configuration 47 (step 3). In one or examples, the insertion aid 91 may even be configured to insert all of the ring fastening members 50 of the plurality of ring fastening members 50 into a first opening 16 of a sheet 10 simultaneously.

Figure 16:
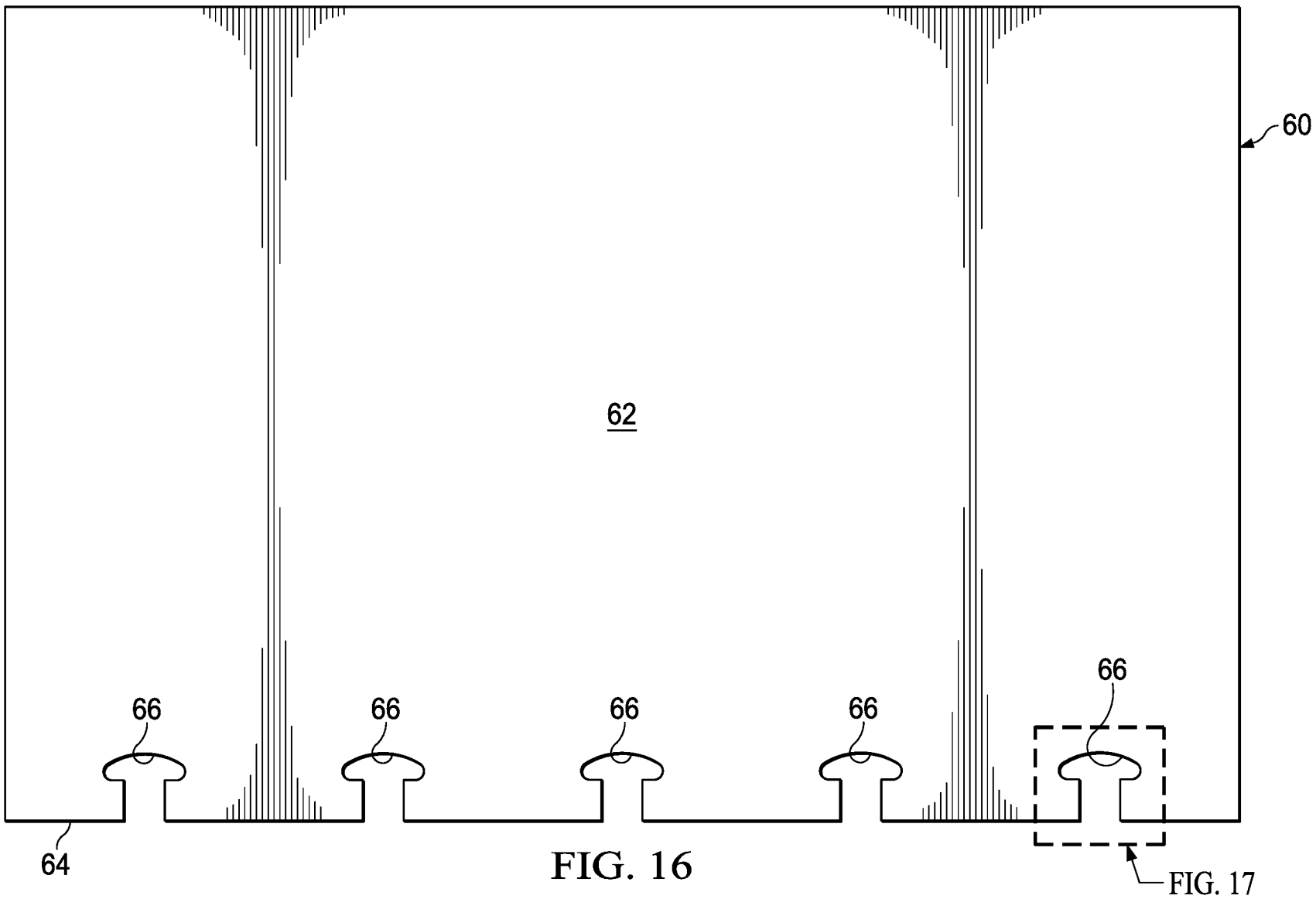
FIG. 16 is a top plan view of a cover of the notebook binding system of FIG. 1.

Referring to FIG. 16, the notebook binding system 100 may further include one or more covers 60 positioned proximate the stack 12 of sheets 10 (e.g. on opposite ends). As shown, the cover(s) 60 may be substantially planar, and relatively similar in size and shape to the sheets 10. The cover(s) 60 may be employed to provide a degree of protection to the stack 12 and, accordingly, may be fabricated from tougher, substantially more rigid materials than the sheets 10. Examples of suitable materials may include wooden material, metallic material, polymeric material, and any combinations thereof.

Each cover 60 may include a plurality of second openings 66 spaced apart along an edge 64 of the respective covers 60. The spacing of the plurality of second openings 66 should substantially align with the pluralities of first openings 16 such that a ring fastening member 50 that is inserted into a first opening 16 of a sheet 10 would be insertable into a corresponding second opening 66 in the cover(s) 60. In this way, the ring fasting member 50 would retain the cover(s) 60 proximate the stack 12.

Figure 17:
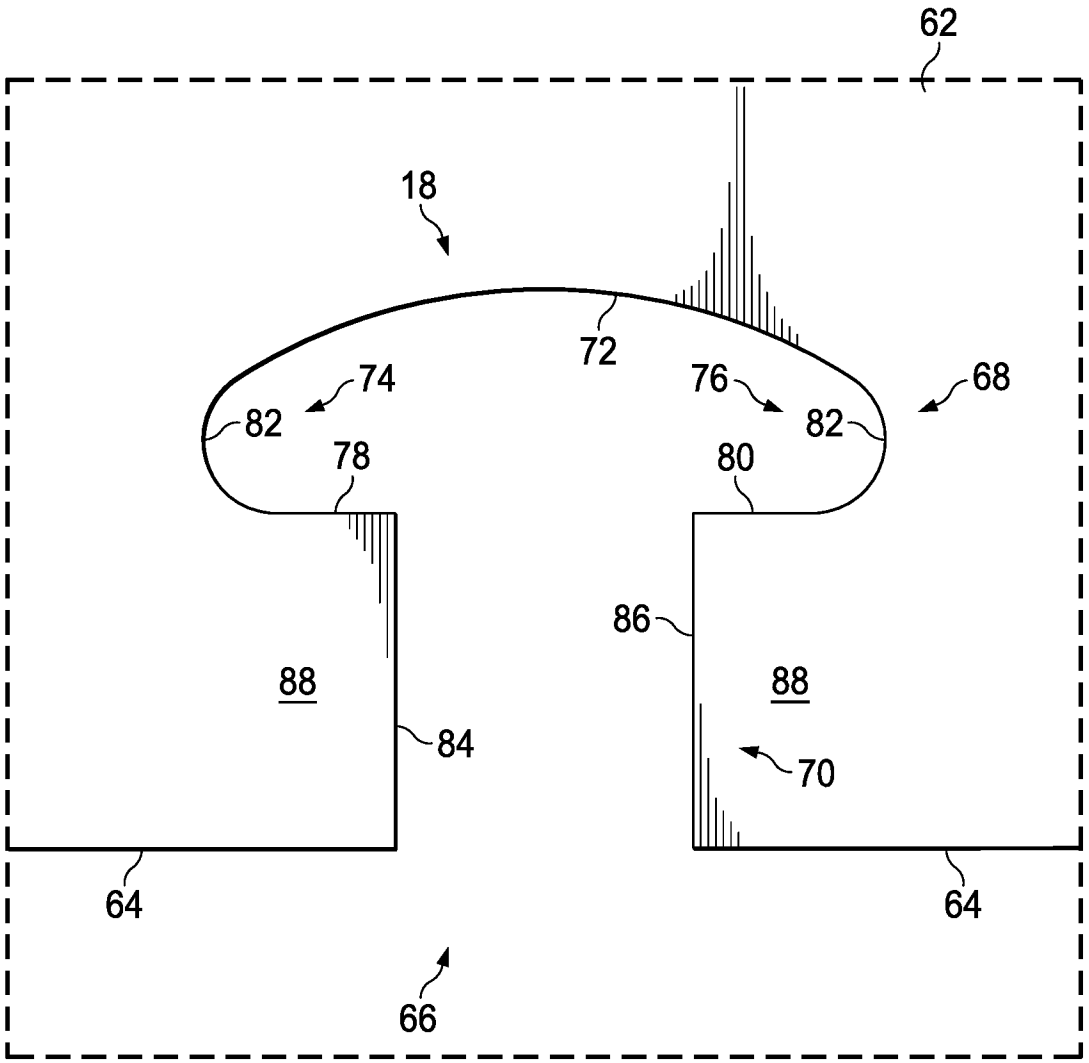
FIG. 17 is a top plan view of a second opening of the plurality of second openings of the cover of FIG. 16.

Referring to FIG. 17, each second opening 66 of the plurality of second openings 66 of any given cover 60 may have the same generally mushroom-shaped configuration 18 as the first openings 16. That is to say, each second opening 66 of the plurality of second openings 66 may include a cap portion 68 and a stem portion 70 between the cap portion 68 and the edge 64 of the cover 60. Both the cap portion 68 and the stem portion 70 may define a length and a width. Since the covers 60 are likely to be more rigid than the sheets 10, it is generally contemplated that the covers 60 may be provided with relatively wide stem portions 40, and may be fastened using the second method.

Ideally, the second openings 66 should have a similar shape as the first openings 16 to ensure smooth movement about the ring fastening members 50. The example shown in FIGS. 16 and 17 may be suitably utilized with the examples of first openings 16 shown in FIGS. 1-12. As shown, the cap portion 68 of the second openings 66 may be defined by a first arcuate surface 72, a first end portion 74, a second end portion 76, a substantially flat first bearing surface 78 and a substantially flat second bearing surface 80 in the cover 60. As configured, the first arcuate surface 72 of the cover 60 may curve along the width of the cap portion 68 into the first and second end portions 74, 76 of the cap portion 68. The first and second end portions 74, 76 may each include, for example, second arcuate surfaces 82 that connect the first arcuate surface 72 to the substantially flat first bearing surface 78 and the substantially flat second bearing surface 80. Further, the stem portion 70 may be defined by a first opposing surface 84 and a second opposing surface 86, wherein the first opposing surface 84 is opposed from the second opposing surface 86. The first and second opposing surfaces 84, 86 may each be respectively located on opposing portions 88 of the cover 60 (collectively referred to as a "pair of opposing portions"), wherein each opposing portion 88 of the pair of opposing portions 88 also includes one of the substantially flat first 78 and second bearing surfaces 80, as well as a portion of the edge 64.

Figure 18:
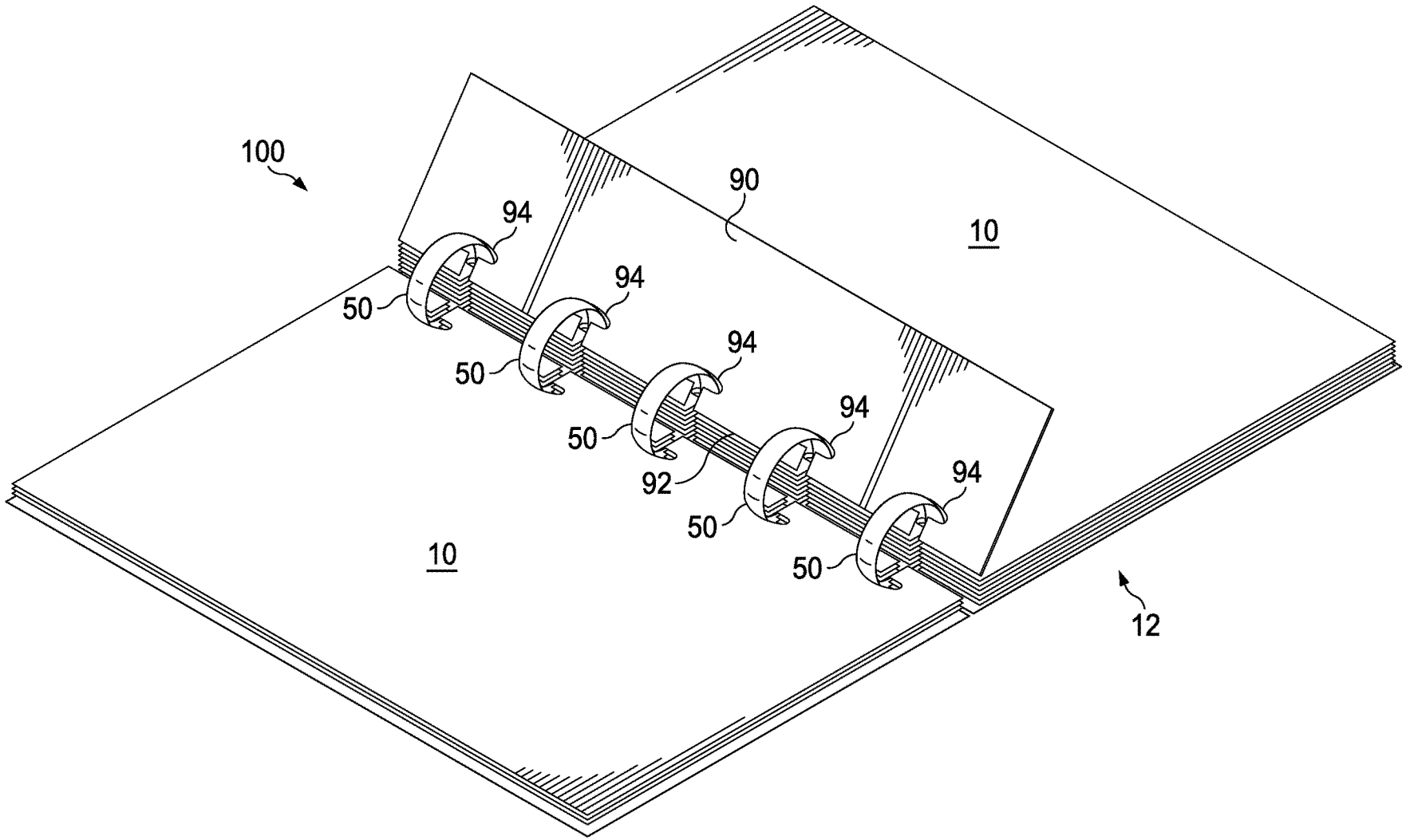
FIG. 18 is a perspective view of a divider positioned between two sheets of a notebook binding system.

At this point, those skilled in the art will appreciate that various other additional features may be releasably connected to the notebook binding system 100 via the same configuration by which the cover(s) 60 are releasably connected. For example, the notebook binding system may further include a divider 90 that is insertable between two sheets 10 of the stack 12 (FIG. 18). The divider 90 may include an edge 92 and a plurality of third openings 94 spaced apart along the edge 92 of the divider 90 such that each third opening 94 of the plurality of third openings 94 is substantially aligned with a first opening 16 of a plurality of first openings 16. Ring fastening members 50 may then be inserted into these third openings 94 to retain the divider 90 between two sheets 10 of the stack 12. Ideally, these third openings 94 should have a similar shape as the first openings 16 to ensure smooth movement about the ring fastening members 50. Accordingly, other additional features may include, for example, pluralities of fourth openings, pluralities of fifth openings, etc.

Optionally, in one or more examples, the divider 90 may be longer than the sheets 10 such that the divider 90 protrudes from the sides of the notebook binding system 100. The added length enables a user of the notebook binding system 100 to easily discern his/her position relative to the stack 12 of sheets 10, even when the notebook binding system 100 is closed (FIG. 1). Further, the divider 90 may also be provided with markings/indicia that a user may find useful. For example, the divider 90 may include, among other things, a ruler, a calendar, a to-do list, and/or any combinations thereof printed on its major sides. Those skilled in the art will appreciate that various other markings/indicia may be printed on the divider 90 without departing from the scope of the present disclosure.

Figure 19:
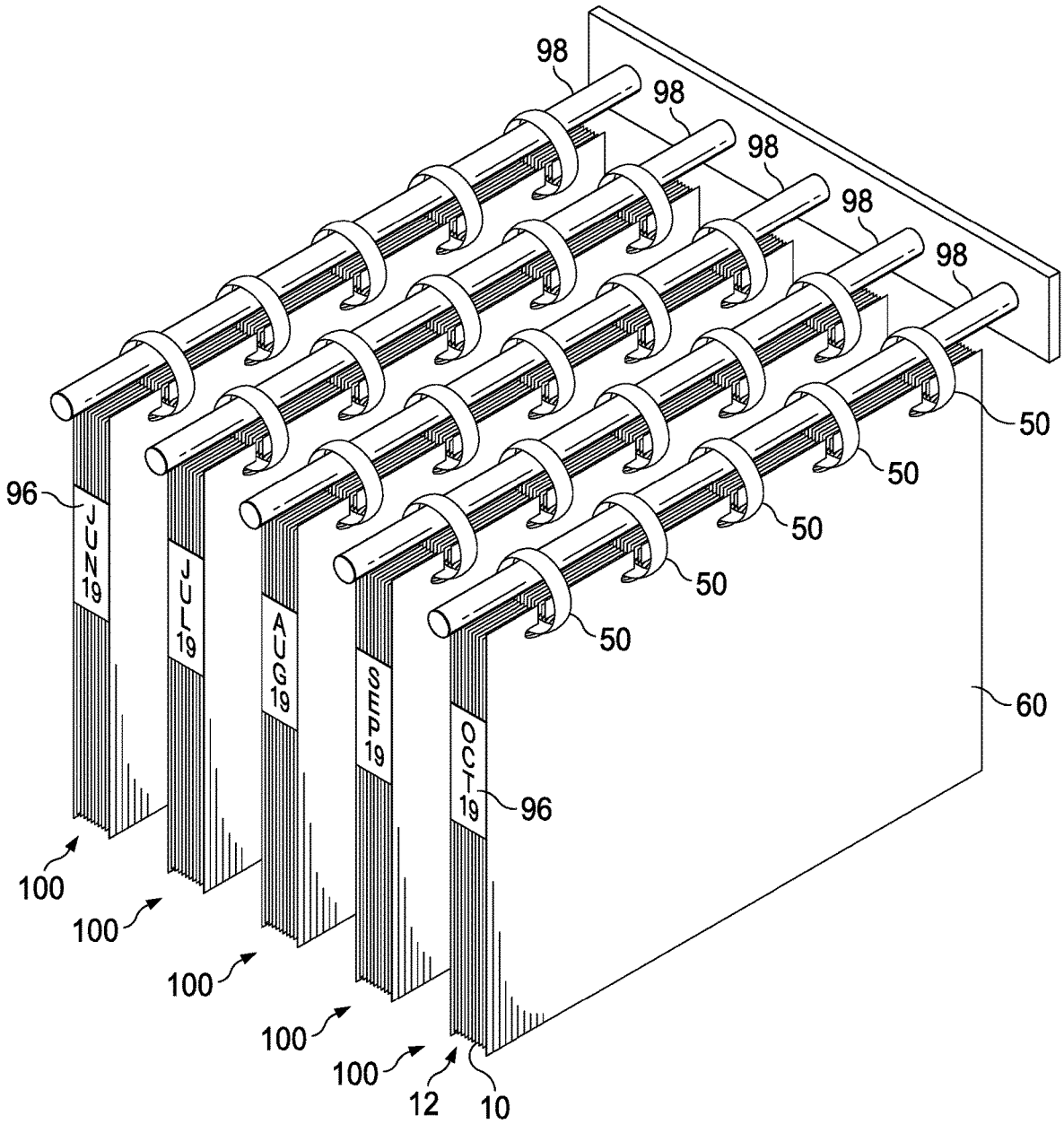
FIG. 19 is a perspective view of multiple notebook binding systems that are organized by being suspended from multiple rod members.

Referring to FIG. 19, in one or more examples, the notebook binding system 100 may optionally include one or more identification tabs 96 fixedly connected to the cover(s) 60. These identification tab(s) 96 may include preprinted messages and/or designs, or may be left blank to be written on. The size, shape, and material composition of the identification tab(s) 96 may be varied as desired without resulting in a departure from the scope of the present disclosure. Further, the identification tab(s) 96 may be fixedly connected to the cover(s) 60 by way of, for example, sewing, adhesive bonding, mechanical fastening, and the like.

In yet another example, the notebook binding system 100 may further include a rod member 98 that is insertable into at least one ring fastening member 50 of the plurality of ring fastening members 50. Those skilled in the art will appreciate that the ability of the notebook binding system 100 to incorporate such a rod member 98 is distinguishable from, for example, discbound notebook systems because rods are not insertable through solid discs. Once inserted, the stack 12 of sheets 10 may be hung from the rod member 98 while the plurality of ring fastening members 50 forms a link between the two 12, 98. As such, it is generally contemplated that the rod member 98 should be fabricated from a material that is rigid enough to support the weight of, at the very least, the stack 12 of sheets 10 and the plurality of ring fastening members 50. Metallic and/or polymeric material, for example, may be well suited for this purpose.

Although various examples of the disclosed notebook binding system 100 have been shown and described, modifications may occur to those skilled in the art upon reading the specification. The present application includes such modifications and is limited only by the scope of the claims.

What is claimed is:

1. A notebook binding system comprising:

a plurality of sheets, wherein:

each sheet of said plurality of sheets comprises an edge and a plurality of first openings spaced apart along said edge of said sheet;

each first opening of each plurality of first openings comprises a cap portion and a stem portion between said cap portion and said edge, said cap portion defining a cap width and said stem portion defining a stem width that is less than said cap width;

said plurality of sheets are arranged in a stack such that each first opening of every plurality of first openings is substantially aligned with another first opening of another plurality of first openings; and a plurality of ring fastening members, wherein:

each ring fastening member comprises a body and a hole, said body defining an inwardly-facing surface, and said hole extending continuously through said ring fastening member parallel to said inwardly-facing surface;

each ring fastening member of said plurality of ring fastening members is insertable into said first openings of said plurality of sheets to retain said sheets in said stack; at least two ring fastening members of said plurality of ring fastening members is inserted into different openings of a sheet of said plurality of sheets; and wherein a ring fastening member of said plurality of ring fastening members comprises a convex outer surface, and a first opening of said plurality of first openings comprises a first arcuate surface that is substantially concentric with said convex outer surface.

2. The notebook binding system according to claim 1, wherein:

a sheet of said plurality of sheets comprises a pair of opposing portions and a remainder portion that comprises the remainder of said sheet excluding said pair of opposing portions;

said pair of opposing portions is located along said edge of said sheet and defines, at least in part, a first stem portion of a first opening of said sheet; and each opposing portion of said pair of opposing portions is bendable between at least a planar configuration and a bent configuration, said planar configuration comprising planarity with said remainder portion, said bent configuration comprising non-planarity with said remainder portion.

3. The notebook binding system according to claim 2, wherein said first stem portion is configured to permit a ring fastening member to pass through said first stem portion when at least one opposing portion of said pair of opposing portions is in said bent configuration, and to prevent passage through said first stem portion when at least one opposing portion of said pair of opposing portions is in said planar configuration.

4. The notebook binding system according to claim 1, wherein a ring fastening member of said plurality of ring fastening members comprises a ring width that is less than 90 percent of a cap width of a first opening of a plurality of first openings.

5. The notebook binding system according to claim 1, wherein:

a ring fastening member of said plurality of ring fastening members comprises a ring thickness;

a cap portion of a plurality of first openings comprises a cap length; and said ring thickness of said ring fastening members is less than 55 percent of said cap length.

6. The notebook binding system according to claim 1, wherein:

a ring fastening member of said plurality of ring fastening members comprises a ring width; and a first opening of a plurality of first openings comprises a stem width that is at least 15 percent of said ring width.

7. The notebook binding system according to claim 1, wherein a first opening of a plurality of first openings comprises a cap portion that comprises a substantially flat first bearing surface and a substantially flat second bearing surface.

8. The notebook binding system according to claim 7, wherein:

a ring fastening member of said plurality of ring fastening members comprises a convex outer surface and an inwardly-facing surface that is a substantially flat inwardly-facing bearing surface configured to bear upon said substantially flat first bearing surface and said substantially flat second bearing surface of said first opening; and said ring fastening member defines a ring diameter measured between two diametrically opposed points on said convex outer surface of said ring fastening member and a hole diameter measured between two diametrically opposed points on said substantially flat inwardly-facing bearing surface.

9. The notebook binding system according to claim 8 wherein said stack of sheets comprises a stack thickness that is less than 75 percent of said hole diameter.

10. The notebook binding system according to claim 8 wherein said hole diameter ranges from about 75 percent to about 95 percent of said ring diameter.

11. The notebook binding system according to claim 1, wherein said first arcuate surface has an arc radius of approximately 7.65 millimeters.

12. The notebook binding system according to claim 1, wherein a cap portion of a plurality of first openings comprises a first end portion and a second end portion, and wherein said first end portion and said second end portion each comprise a second arcuate surface.

13. The notebook binding system according to claim 12, wherein said second arcuate surface of said first end portion and said second arcuate surface of said second end portion of said cap portion each comprises an arc radius of approximately 1.0 millimeters.

14. The notebook binding system according to claim 1 further comprising a cover proximate said stack of sheets, said cover comprising an edge and a plurality of second openings spaced apart along said edge such that said second openings are substantially aligned with said first openings of said stack of sheets, and wherein said plurality of ring fastening members are further insertable into said plurality of second openings to retain said cover proximate said stack.

15. The notebook binding system according to claim 14 wherein each second opening of said plurality of second openings comprises a stem portion and a cap portion.

16. The notebook binding system according to claim 15 wherein a sheet of said plurality of sheets comprises first openings having stem widths that are less than said stem widths of said second openings.

* * * * *